US010341774B2

(12) United States Patent
Inoue et al.

(10) Patent No.: US 10,341,774 B2
(45) Date of Patent: Jul. 2, 2019

(54) VIDEO AUDIO SYSTEM

(71) Applicant: FUJIFILM Corporation, Tokyo (JP)

(72) Inventors: Daisuke Inoue, Ashigara-kami-gun (JP); Tetsu Miyoshi, Ashigara-kami-gun (JP); Shin Ozawa, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/948,019

(22) Filed: Apr. 9, 2018

(65) Prior Publication Data

US 2018/0229271 A1 Aug. 16, 2018

Related U.S. Application Data

(63) Continuation of application No. PCT/JP2016/080535, filed on Oct. 14, 2016.

(30) Foreign Application Priority Data

Oct. 21, 2015 (JP) ..... 2015-207028

(51) Int. Cl.
*H04R 5/02* (2006.01)
*B06B 1/06* (2006.01)
(Continued)

(52) U.S. Cl.
CPC ..... *H04R 5/02* (2013.01); *B06B 1/0629* (2013.01); *B06B 1/0662* (2013.01); *H04R 7/06* (2013.01);
(Continued)

(58) Field of Classification Search
CPC . H04R 1/02; H04R 1/40; H04R 17/00; H04R 17/005; H04R 2499/15; B06B 1/06291; B06B 1/0662
See application file for complete search history.

(56) References Cited

U.S. PATENT DOCUMENTS

2012/0183162 A1 7/2012 Chabanne et al.
2013/0256581 A1 10/2013 Miyoshi et al.
(Continued)

FOREIGN PATENT DOCUMENTS

CN 103262275 A 8/2013
CN 103843365 A 6/2014
(Continued)

OTHER PUBLICATIONS

International Preliminary Report on Patentability (Form PCT/IPEA/409), dated Oct. 27, 2017, for International Application No. PCT/JP2016/080535, with an English Translation.
(Continued)

*Primary Examiner* — Joshua Kaufman
(74) *Attorney, Agent, or Firm* — Birch, Stewart, Kolasch & Birch, LLP

(57) ABSTRACT

Provided is a video audio system including electroacoustic conversion units which include an electroacoustic conversion film having a macromolecular composite piezoelectric body formed by dispersing piezoelectric body particles in a viscoelastic matrix formed of a macromolecular material that is viscoelastic at normal temperature and thin film electrodes respectively laminated on both surfaces of the macromolecular composite piezoelectric body, curve and support the electroacoustic conversion film, and use at least a part of the electroacoustic conversion film as vibration regions and a display device which is a screen or a video display device to which videos are projected, in which at least one of the electroacoustic conversion units is disposed on a rear surface opposite to a surface of the display device on which videos are displayed, the plurality of vibration regions is arranged on the entire rear surface of the display device, and location information of the vibration regions is
(Continued)

included in sound data that are input to the electroacoustic conversion units.

11 Claims, 5 Drawing Sheets

(51) Int. Cl.
*H04R 17/00* (2006.01)
*H04R 7/06* (2006.01)

(52) U.S. Cl.
CPC ..... *H04R 17/00* (2013.01); *H04R 17/005* (2013.01); *H04R 2499/15* (2013.01); *H04S 2400/11* (2013.01)

(56) References Cited

U.S. PATENT DOCUMENTS

| | | | | |
|---|---|---|---|---|
| 2014/0133683 | A1 | 5/2014 | Robinson et al. | |
| 2014/0210309 | A1* | 7/2014 | Miyoshi ..... | H04R 7/04 310/313 A |
| 2016/0008852 | A1 | 1/2016 | Miyoshi | |

FOREIGN PATENT DOCUMENTS

| | | | | |
|---|---|---|---|---|
| JP | 5-244550 | A | 9/1993 | |
| JP | 2009-17438 | A | 1/2009 | |
| JP | 2013-51686 | A | 3/2013 | |
| JP | 2014-522155 | A | 8/2014 | |
| JP | 2014-180044 | A | 9/2014 | |
| JP | 2014-195132 | A | 10/2014 | |
| JP | WO 2014157351 | A1 * | 10/2014 | ..... H04R 17/005 |
| JP | 2015-109627 | A | 6/2015 | |
| WO | WO 2014/157351 | A1 | 10/2014 | |

OTHER PUBLICATIONS

International Search Report (PCT/ISA/210) issued in PCT/JP2016/080535, dated Jan. 10, 2017.
Written Opinion (PCT/ISA/237) issued in PCT/JP2016/080535, dated Jan. 10, 2017.
German Office Action, dated Sep. 7, 2018, for German Application No. 112016004292.2, with an English translation.
Chinese Office Action and Search Report, dated Dec. 27, 2018, for corresponding Chinese Application No. 201680060103.4, with an English translation of the Office Action.

* cited by examiner

VIDEO AUDIO SYSTEM

CROSS-REFERENCE TO RELATED APPLICATIONS

This application is a Continuation of PCT International Application No. PCT/JP2016/080535 filed on Oct. 14, 2016, which claims priority under 35 U.S.C. § 119(a) to Japanese Patent Application No. 2015-207028 filed on Oct. 21, 2015. The above application is hereby expressly incorporated by reference, in its entirety, into the present application.

BACKGROUND OF THE INVENTION

1. Field of the Invention

The present invention relates to a video audio system including a display device that displays videos and electroacoustic conversion units that reproduce sound.

2. Description of the Related Art

In display devices such as video audio systems that reproduce videos and audios in movie theaters and liquid crystal displays or electro luminescence (EL) displays that receive television broadcasts such as terrestrial broadcasts and reproduce videos and audios or reproduce videos and audios recorded in recording media such as digital versatile discs (DVD), the locations of sound sources are virtually reproduced in a multi-channel (2-channel or 5.1-channel) manner using a plurality of speakers in order to reproduce audios that feel realistic.

For example, JP2014-522155A describes a layout of speakers in ordinary movie theaters and describes a plurality of speakers such as front speakers, center speakers, and rear speakers on the right and left sides disposed in a multi-channel manner so as to surround audience seats, that is, viewers and listeners.

In addition, JP2014-180044A describes a video display device in which two audio transducers are perpendicularly arranged in the vicinity of a video screen and describes that the locations of the sensory perception origins (sound sources) of voice signals on a video plane are determined, two or more speakers corresponding to the horizontal locations of the sound sources are selected, and sounds are reproduced using the selected speakers, thereby generating pseudo sound images on the video plane between the locations of the selected speakers.

In addition, JP2013-51686A describes that a plurality of videos is displayed on a screen in a video display portion at the same time, the locations of virtual sound sources of the videos are set in individual locations in which the plurality of videos is displayed on the screen, and voice signals sounding like the acoustic or audiovisual reproduction of a state in which voices are generated from the virtual sound sources are played using a plurality of speakers.

Meanwhile, JP2015-109627A describes that, in a case in which an electroacoustic conversion film having a macromolecular composite piezoelectric body formed by dispersing piezoelectric body particles in a viscoelastic matrix formed of a macromolecular material that is viscoelastic at normal temperature and thin film electrodes disposed on both surfaces of the macromolecular composite piezoelectric body is attached to the rear surface side of a flexible disc play or a screen and used as a speaker, it is possible to reproduce sound from a direction on which images are displayed and improve the realistic feeling.

SUMMARY OF THE INVENTION

However, in audio systems in which virtual sound sources are set using a plurality of speakers and a state in which sound is generated from the virtual sound sources is reproduced, there is a problem in that the virtual sound sources may not be appropriately reproduced depending on viewer's locations, locations do not match between videos and the sound sources, which disables the localization of sound, and a sufficient realistic feeling cannot be obtained.

In addition, with speakers alone that are disposed on the rear surface side of a display device, it is not possible to impart a sufficient stereoscopic effect to sound, and the realistic feeling is not sufficient.

An object of the present invention is to solve the above-described problems of the related art and to provide a video audio system capable of generating sound at locations in synchronization with videos and improving the realistic feeling.

As a result of intensive studies for achieving the above-described object, the present inventors found that, in a case in which electroacoustic conversion units which include an electroacoustic conversion film having a macromolecular composite piezoelectric body formed by dispersing piezoelectric body particles in a viscoelastic matrix formed of a macromolecular material that is viscoelastic at normal temperature and thin film electrodes respectively laminated on both surfaces of the macromolecular composite piezoelectric body, curve and support the electroacoustic conversion film, and use at least a part of the electroacoustic conversion film as vibration regions and a display device which is a screen or a video display device to which videos are projected are included, at least one of the electroacoustic conversion units is disposed on a rear surface opposite to a surface of the display device on which videos are displayed, the plurality of vibration regions is arranged on the entire rear surface of the display device, and the location information of the vibration regions is included in sound data that are input to the electroacoustic conversion units, the above-described object can be achieved, and completed the present invention.

That is, the present invention provides video audio systems having the following constitutions.

(1) A video audio system comprising: electroacoustic conversion units which include an electroacoustic conversion film having a macromolecular composite piezoelectric body formed by dispersing piezoelectric body particles in a viscoelastic matrix formed of a macromolecular material that is viscoelastic at normal temperature and thin film electrodes respectively laminated on both surfaces of the macromolecular composite piezoelectric body, curve and support the electroacoustic conversion film, and use at least a part of the electroacoustic conversion film as vibration regions; and a display device which is a screen or a video display device to which videos are projected, in which at least one of the electroacoustic conversion units is disposed on a rear surface opposite to a surface of the display device on which videos are displayed, the plurality of vibration regions is arranged on the entire rear surface of the display device, and location information of the vibration regions is included in sound data that are input to the electroacoustic conversion units.

(2) The video audio system according to (1), in which, on the basis of videos that are displayed on the display device, at least one vibration region is selected from the plurality of vibration regions arranged on the rear surface of the display device, and sound is generated.

(3) The video audio system according to (1) or (2), in which a proportion of a total area of the plurality of vibration regions in an area of a region in the display device on which videos are displayed is 80% or more.

(4) The video audio system according to any one of (1) to (3), in which the vibration region has a square shape.

(5) The video audio system according to any one of (1) to (4), in which four or more vibration regions are provided.

(6) The video audio system according to any one of (1) to (5), in which a plurality of electroacoustic conversion units each having one vibration region is provided, and the plurality of electroacoustic conversion units is arranged on the rear surface of the display device.

(7) The video audio system according to any one of (1) to (5), in which the electroacoustic conversion film has a plurality of sets of the thin film electrodes that sandwich the macromolecular composite piezoelectric body and has the plurality of vibration regions formed therein.

(8) The video audio system according to any one of (1) to (7) which is used in any of movie theaters, home theaters, digital signage, projection mapping, and flexible organic EL displays.

According to the present invention described above, it is possible to provide a video audio system capable of generating sound at locations in synchronization with videos and improving the realistic feeling.

DESCRIPTION OF THE PREFERRED EMBODIMENTS

Hereinafter, a video audio system of the present invention will be described in detail on the basis of a preferred embodiment that is illustrated in the accompanying drawings.

Constituent elements described below will, in some cases, be described on the basis of typical embodiments of the present invention, but the present invention is not limited to such embodiments.

Meanwhile, in the present specification, numerical ranges expressed using "to" include numerical values described before and after "to" as the lower limit value and the upper limit value.

The video audio system of the present invention is a video display system including electroacoustic conversion units which include an electroacoustic conversion film having a macromolecular composite piezoelectric body formed by dispersing piezoelectric body particles in a viscoelastic matrix formed of a macromolecular material that is viscoelastic at normal temperature and thin film electrodes respectively laminated on both surfaces of the macromolecular composite piezoelectric body, curve and support the electroacoustic conversion film, and use at least a part of the electroacoustic conversion film as vibration regions, and a display device which is a screen or a video display device to which videos are projected, in which at least one of the electroacoustic conversion units is disposed on a rear surface opposite to a surface of the display device on which videos are displayed, the plurality of vibration regions is arranged on the entire rear surface of the display device, and location information of the vibration regions is included in sound data that are input to the electroacoustic conversion units.

Figure 1A:
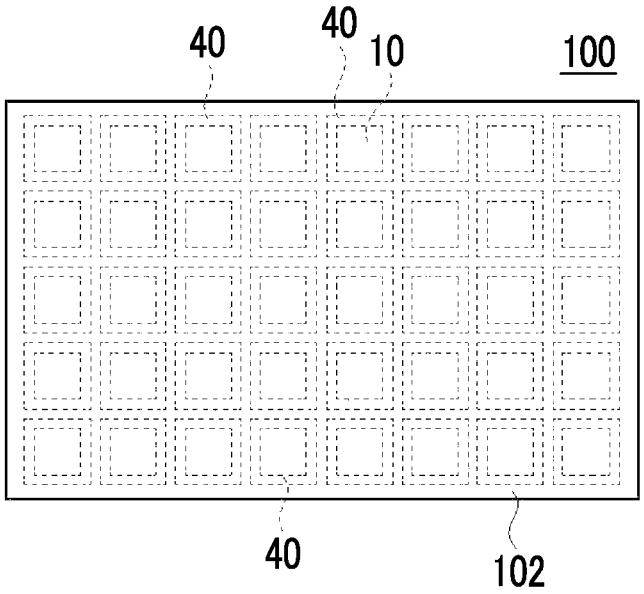
FIG. 1A is a front view conceptually illustrating an example of a video audio system of the present invention.
Figure 1B:
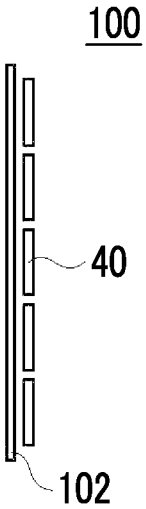
FIG. 1B is a side view of FIG. 1A.

FIG. 1A illustrates a front view schematically illustrating an example of the video audio system of the present invention, and FIG. 1B illustrates a side view of FIG. 1A.

A video audio system 100 illustrated in FIG. 1A and FIG. 1B has a display device 102 that displays videos and a plurality of electroacoustic conversion units (hereinafter, also referred to as "conversion units") 40 which is arranged throughout the entire rear surface side of the display device 102 and is speakers that reproduce sound.

In the video audio system 100 exemplified in the drawings, 40 conversion units 40 are arranged in a matrix form of five rows and eight columns throughout the entire rear surface side of the display device 102.

The conversion units 40 in the present invention use an electroacoustic conversion film having thin film electrodes laminated on both surfaces of a macromolecular composite piezoelectric body formed by dispersing piezoelectric body particles in a viscoelastic matrix formed of a macromolecular material that is viscoelastic at normal temperature as a vibration plate. The conversion units 40 curve and support the electroacoustic conversion film, and the application of voltage to the electroacoustic conversion film extends and contracts the electroacoustic conversion film in an in-plane direction, whereby the electroacoustic conversion film moves upwards (in the radiation direction of sound) or downwards and converts vibrations (sound) and electric signals through vibrations generated by the repetition of the above-described extension and contraction.

In the plurality of conversion units 40 that is arranged throughout the entire rear surface that is opposite to a surface of the display device 102 on which videos are displayed, sound data are input to the respective conversion units 40 on the basis of videos that are displayed on the display device, and sound is generated.

What has been described above will be described below in detail.

First, the display device 102 will be described.

The display device 102 is a screen to which videos from a projector, a moving picture projector, or the like are projected, a liquid crystal display, or a video display device.

The screen is not limited, and it is possible to use a variety of well-known screens that are used as projector screens such as sheet-like screens and the like having a white, silver, or other color which are formed of a resin.

In addition, the video display device is also not limited, and it is possible to use well-known organic electro luminescence (EL) displays, liquid crystal displays, and the like.

Here, the display device 102 is preferably a display device that transmits sound from the rear surface side toward the surface side on which videos are displayed.

Next, the conversion unit 40 will be described.

Figure 2A:
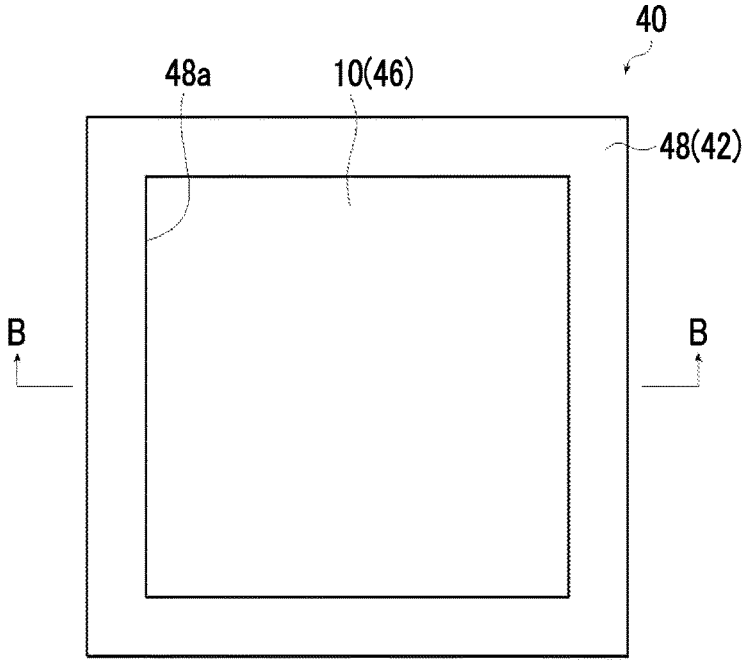
FIG. 2A is a top view schematically illustrating an example of an electroacoustic conversion unit.
Figure 2B:
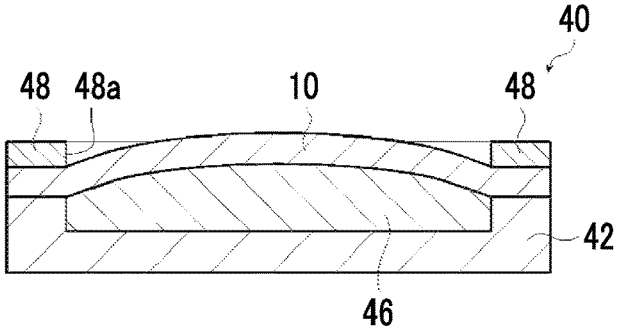
FIG. 2B is a cross-sectional view in a direction of a B-B line in FIG. 2A.

FIG. 2A illustrates a top view schematically illustrating an example of the conversion unit 40, and FIG. 2B illustrates a cross-sectional view in a direction of a B-B line in FIG. 2A.

As described above, the conversion units 40 use the electroacoustic conversion film (hereinafter, also referred to as "conversion film") as a vibration plate.

Figure 3:
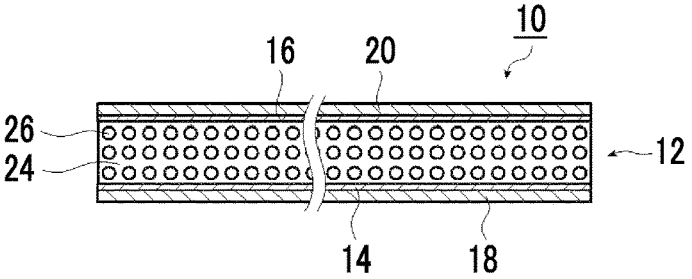
FIG. 3 is a cross-sectional view schematically illustrating an example of an electroacoustic conversion film.

As illustrated in the drawings, the conversion unit 40 is a flat plate-like speaker, and the vertical direction in FIG. 2B is the vibration direction of the conversion film 10, that is, the radiation direction of sound. FIG. 3 is a view seen in the vibration direction of the conversion film 10.

This conversion unit 40 is constituted by having the conversion film 10, a case 42, a viscoelastic support 46, and a pressing member 48.

The conversion film 10 is a piezoelectric film which has piezoelectricity and has a main surface that extends or contracts depending on the state of an electric field, and, in the case of being held in a curved state, the conversion film converts an extension and contraction motion along the film surface to vibrations in a direction perpendicular to the film surface and thus converts electric signals to sound.

Here, the conversion film 10 that is used in the conversion unit 40 is a conversion film having a macromolecular composite piezoelectric body formed by dispersing piezoelectric body particles in a viscoelastic matrix formed of a macromolecular material that is viscoelastic at normal temperature and thin film electrodes respectively laminated on both surfaces of the macromolecular composite piezoelectric body.

The conversion film 10 will be described below in detail.

The case 42 is a holding member that holds the conversion film 10 and the viscoelastic support 46 in association with the pressing member 48. The case 42 is a box-like chassis which is formed of plastic, metal, wood, or the like and has one open surface. In the example illustrated in the drawings, the case 42 has a shape of a thin hexahedron, and one of the largest surfaces is the open surface. In addition, the open portion has a square shape. The case 42 accommodates the viscoelastic support 46 therein.

Meanwhile, in the conversion unit, the shape of the case 42 (that is, the shape of the conversion unit) is not limited to a square cylindrical shape, and a chassis having one of a variety of shapes such as a cylindrical shape or a square cylindrical shape having a rectangular bottom surface can be used.

The viscoelastic support 46 is an element which has appropriate viscosity and elasticity and is intended to hold the conversion film 10 in a curved state and impart a constant mechanical bias to any places in the conversion film 10 so as to convert the extension and contraction motion of the conversion film 10 to a forward and backward motion (a motion in a direction perpendicular to the surface of the conversion film) without any waste.

In the example illustrated in the drawings, the viscoelastic support 46 has a shape of a quadrangular prism having almost the same bottom surface shape as the bottom surface of the case 42. In addition, the height of the viscoelastic support 46 is greater than the depth of the case 42.

The material of the viscoelastic support 46 is not particularly limited as long as the material has appropriate viscosity and elasticity, does not hinder the vibration of the piezoelectric film, and appropriately deforms. Examples thereof include non-woven fabrics such as felt of sheep wool and felt of sheep wool including rayon or PET, glass wool, foaming materials (foamed plastic) such as polyurethanes, polyester wool, materials obtained by overlapping a plurality of sheets of paper, magnetic fluids, paint, and the like.

The specific weight of the viscoelastic support 46 is not particularly limited and may be appropriately selected depending on the type of the viscoelastic support. As an example, in a case in which felt is used as the viscoelastic support, the specific weight is preferably 50 to 500 $kg/m^3$ and more preferably 100 to 300 $kg/m^3$. In addition, in a case in which glass wool is used as the viscoelastic support, the specific weight is preferably 10 to 100 $kg/m^3$.

The pressing member 48 is an element for supporting the conversion film 10 in a state of being pressed to the viscoelastic support 46 and is a plate-like member which is formed of plastic, metal, wood, or the like, has an opening portion in the center, and has a square shape. The pressing member 48 has the same shape as the open surface of the case 42, and the shape of the opening portion is the same square shape as that of the opening portion of the case 42.

The conversion unit 40 is constituted by accommodating the viscoelastic support 46 in the case 42, covering the case 42 and the viscoelastic support 46 with the conversion film 10, and fixing the pressing member 48 to the case 42 in a state in which the periphery of the conversion film 10 is brought into contact with the open surface of the case 42 using the pressing member 48.

Meanwhile, the method for fixing the pressing member 48 to the case 42 is not particularly limited, and it is possible to use a variety of well-known methods such as a method in which vices or bolts and nuts are used and a method in which a fixing jig is used.

In the conversion unit 40, the height (thickness) of the viscoelastic support 46 is greater than the height of the inner surface of the case 42. That is, in a state in which the conversion film 10 and the pressing member 48 are not yet fixed to the case, the viscoelastic support 46 is in a state of protruding from the upper surface of the case 42.

Therefore, in the conversion unit 40, the viscoelastic support 46 is held in a state in which the viscoelastic support 46 is pressed downwards by the conversion film 10 and decreases in thicknesses as the viscoelastic support 46 comes closer to the peripheral portion. That is, the viscoelastic support is held in a state in which at least a part of the main surface of the conversion film 10 is curved. Therefore, a curved portion is formed in at least a part of the conversion film 10. In the conversion unit 40, this curved portion serves as a vibration region. In the following description, the curved portion will be referred to as the vibration region.

At this time, it is preferable that the entire surface of the viscoelastic support 46 is pressed and thus the thickness becomes thin throughout the entire surface in the surface direction of the conversion film 10. That is, it is preferable that the entire surface of the conversion film 10 is pressed and supported by the viscoelastic support 46.

In addition, the curved portion formed as described above preferably has a curvature that slightly changes toward the peripheral portion from the center. In such a case, the resonance frequency is dispersed, and the bandwidth can be further broadened.

In addition, in the conversion unit 40, the viscoelastic support 46 is in a state of being further contracted in the thickness direction as the viscoelastic support comes closer to the pressing member 48, but it is possible to constantly maintain a mechanical bias in any places in the conversion film 10 through a static viscoelastic effect (stress relaxation). Therefore, the extension and contraction motion of the conversion film 10 is converted to a forward and backward motion without any waste, and thus it is possible to obtain a thin and flat surface-like conversion unit 40 which is capable of obtaining a sufficient sound volume and is excellent in terms of acoustic characteristics.

In the conversion unit 40 having the above-described constitution, a region in the conversion film 10 which corresponds to the opening portion of the pressing member 48 becomes a region that actually vibrates. That is, the pressing member 48 is a portion that specifies the vibration region. Therefore, the conversion unit 40 illustrated in FIG. 2 has one vibration region.

Conversion units in which a conversion film having piezoelectricity is used facilitate an increase in the relative size of a vibration plate with respect to the size of the entire unit and a decrease in the size compared with corn speakers in which, generally, a vibration plate has a circular shape.

In addition, the surface of the conversion unit 40 on the conversion film 10 side is preferably similar to the curved portion. That is, the outer shape of the pressing member 48 and the shape of the opening portion are preferably similar to each other.

Meanwhile, in the conversion unit 40, the pressing force on the viscoelastic support 46 by the conversion film 10 is not particularly limited, but is preferably set to 0.005 to 1.0 MPa and particularly set to approximately 0.02 to 0.2 MPa in terms of the surface pressure at a location having a low surface pressure.

Additionally, the thickness of the viscoelastic support 46 is also not particularly limited, but the thickness before being pressed is preferably 1 to 100 mm and particularly 10 to 50 mm.

In addition, in the example illustrated in the drawings, the conversion unit is provided with the constitution in which the viscoelastic support 46 having viscoelasticity is used, but the constitution is not limited thereto, and the conversion unit may have a constitution in which an elastic support having at least elasticity is used.

For example, the conversion unit may be provided with a constitution in which an elastic support having elasticity is used instead of the viscoelastic support 46.

Examples of the elastic support include natural rubber and a variety of synthetic rubber.

Here, in the conversion unit 40 illustrated in FIG. 3, the entire periphery of the conversion film 10 is pressed to the case 42 by the pressing member 48, but the present invention is not limited thereto.

That is, for the conversion unit in which the conversion film 10 is used, it is also possible to use a constitution in which the pressing member 48 is not provided and the conversion film 10 is pressed/fixed to the upper surface of the case 42 using vices, bolts and nuts, jigs, or the like at, for example, the four corners of the case 42.

In addition, between the case 42 and the conversion film 10, an 0 ring or the like may be interposed. In a case in which the conversion unit has the above-described constitution, a damper effect can be imparted, and the transmission of the vibration of the conversion film 10 to the case 42 is prevented, and thus superior acoustic characteristics can be obtained.

In addition, the conversion unit in which the conversion film 10 is used may not have the case 42 that accommodates the viscoelastic support 46.

For example, it is also possible to use a constitution in which the viscoelastic support is placed on a supporting plate having stiffness, the conversion film 10 is placed so as to cover the viscoelastic support, the same pressing member as described above is placed on the peripheral portion, and then the pressing member is fixed to the supporting plate using vices or the like, thereby pressing the viscoelastic support in association with the pressing member.

Meanwhile, the size of the supporting plate may be set to be larger than that of the viscoelastic support, and furthermore, regarding the material of the supporting plate, in a case in which a variety of vibration plates of polystyrene, foamed PET, or carbon fiber are used, it is also possible to expect an effect of further amplifying the vibration of the conversion unit.

Furthermore, the conversion unit is also not limited to the constitution in which the periphery is pressed, and it is also possible to use, for example, a constitution formed by pressing the center of a laminate of the viscoelastic support 46 and the conversion film 10 using any means.

That is, for the conversion unit, it is possible to use a variety of constitutions as long as the conversion film 10 is held in a curved state.

Alternatively, the conversion unit may have a constitution in which the conversion film 10 is attached to a resin film and is thus imparted with a tensile force (curved). In a case in which the conversion unit is provided with a constitution in which the conversion unit is held by a resin film and can be held in a curved state, it is possible to turn the conversion unit into a flexible speaker.

Alternatively, the conversion unit may also be provided with a constitution in which the conversion film 10 is attached to a curved frame.

In addition, in the example illustrated in FIG. 2A and FIG. 2B, the conversion unit is provided with the constitution in which the conversion film 10 is pressed to and supported by the viscoelastic support 46 using the pressing member 48, but the constitution is not limited thereto, and the conversion unit may be provided with a constitution in which, for example, an end portion of the conversion film 10 is fixed to the rear surface side of the case 42 using the conversion film 10 that is larger than the opening surface of the case 42. That is, the end portion of the conversion film may be fixed to the rear surface side of the case 42 by covering the case 42 and the viscoelastic support 46 disposed in the case 42 with the conversion film 10 that is larger than the opening surface of the case 42 and pulling the end portion of the conversion film 10 toward the rear surface side of the case 42 so as to press the conversion film 10 to the viscoelastic support 46, impart a tensile force, and curve the conversion film.

Alternatively, the conversion unit may be provided with a constitution in which an airtight case is used, an open end of the case is sealed by covering the open end with the conversion film, and gas is introduced into the case so as to apply a pressure to the conversion film and hold the conversion film in a state of being swollen in a convex shape or the inside of the case is depressurized so as to hold the conversion film in a state of being sunk in a concave shape.

In addition, the conversion unit 40 illustrated in FIG. 2A and FIG. 2B is provided with the constitution in which the conversion film 10 is pressed by the viscoelastic support 46 and is held in a state in which the main surface is curved in a convex shape, but the constitution in which the conversion film 10 is held in a curved state as described above is not particularly limited.

For example, the conversion film 10 may be curved by forming a convex portion therein. The method for forming a convex portion is not particularly limited, and it is possible to use a variety of well-known processing methods of resin films. For example, the convex portion can be formed using a forming method such as a vacuum pressurization shaping method or an embossing process.

Next, the conversion film that is used in the conversion unit will be described.

FIG. 3 is a cross-sectional view conceptually illustrating an example of the conversion film 10.

As illustrated in FIG. 3, the conversion film 10 has a piezoelectric body layer 12 which is a piezoelectric sheet-like substance, a lower portion thin film electrode 14 which is laminated on one surface of the piezoelectric body layer 12, a lower portion protective layer 18 which is laminated on the lower portion thin film electrode 14, an upper portion thin film electrode 16 which is laminated on the other surface of the piezoelectric body layer 12, and an upper portion protective layer 20 which is laminated on the upper portion thin film electrode 16.

In the conversion film 10, the piezoelectric body layer 12 is made of a macromolecular composite piezoelectric body.

As conceptually illustrated in FIG. 3, the macromolecular composite piezoelectric body that forms the piezoelectric body layer 12 is a piezoelectric body obtained by dispersing piezoelectric body particles 26 in a viscoelastic matrix 24 containing a macromolecular material that is viscoelastic at normal temperature. Meanwhile, in the present specification, "normal temperature" refers to a temperature range of approximately 0° C. to 50° C.

In addition, the piezoelectric body layer 12 is preferably polarization-treated.

Here, the macromolecular composite piezoelectric body (piezoelectric body layer 12) preferably has the following requirements.

(i) Flexibility

For example, in a case in which the macromolecular composite piezoelectric body is grasped in a loosely-bent state like a document such as a newspaper or a magazine in a portable application, the macromolecular composite piezoelectric body is continuously subjected to a relatively slow-phased and large external bending deformation of several hertz or less. At this time, in a case in which the macromolecular composite piezoelectric body is hard, there is a concern that, accordingly, a large bending stress may be generated, cracks may be generated in the interfaces between a macromolecular matrix and the piezoelectric body particles, and consequently, the macromolecular composite piezoelectric body may break. Therefore, the macromolecular composite piezoelectric body needs to have an appropriate softness. In addition, in a case in which the diffusion of the strain energy to the outside as heat is possible, it is possible to relax the stress. Therefore, the loss tangent of the macromolecular composite piezoelectric body needs to be appropriately great.

(ii) Audio Quality

In speakers, the piezoelectric body particles are vibrated at frequencies of an audio band of 20 Hz to 20 kHz, and the resultant vibration energy integrally vibrates the entire vibration plate (macromolecular composite piezoelectric body), thereby reproducing sound. Therefore, the macromolecular composite piezoelectric body needs to have an appropriate hardness in order to increase the transmission efficiency of the vibration energy. In addition, in a case in which the frequency characteristic of speakers is flat, the amount of audio quality changed during a change in the lowest resonance frequency $f_0$ caused by a change in the curvature also decreases. Therefore, the loss tangent of the macromolecular composite piezoelectric body needs to be appropriately great.

According to the summary of what has been described above, the macromolecular composite piezoelectric body which is used in flexible speakers needs to act rigidly with respect to vibrations of 20 Hz to 20 kHz and act softly with respect to vibrations of several hertz or less. In addition, the loss tangent of the macromolecular composite piezoelectric body needs to be appropriately great with respect to vibrations of all frequencies of 20 kHz or less.

Generally, macromolecular solids have a viscoelastic relaxation mechanism, and, together with an increase in the temperature or a decrease in the frequency, a large scale of molecular motion is observed as a decrease (relaxation) of the storage elastic modulus (Young's modulus) or the maximum (absorption) of the loss elastic modulus. Among these, relaxation caused by the micro-Brownian motion of molecular chains in an amorphous region is referred to as major dispersion, and an extremely large relaxation phenomenon is shown. The temperature at which this major dispersion occurs is the glass transition temperature (Tg), and the most viscoelastic relaxation mechanism is significantly shown.

In a case in which a macromolecular material having a glass transition temperature at normal temperature, in other words, a macromolecular material that is viscoelastic at normal temperature is used as the matrix in the macromolecular composite piezoelectric body (piezoelectric body layer 12), a macromolecular composite piezoelectric body that acts rigidly with respect to vibrations of 20 Hz to 20 kHz and act softly with respect to slow vibrations of several hertz or less is realized. In particular, a macromolecular material having a glass transition temperature at normal temperature, that is, 0° C. to 50° C. at a frequency of 1 Hz is preferably used as the matrix in the macromolecular composite piezoelectric body since the above-described action preferably develops.

As the macromolecular material that is viscoelastic at normal temperature, it is possible to use a variety of well-known macromolecular materials. A macromolecular material in which the maximum value of the loss tangent Tan δ at a frequency of 1 Hz by a dynamic viscoelastic test is 0.5 or more at normal temperature, that is, 0° C. to 50° C. is preferably used.

In such a case, when the macromolecular composite piezoelectric body is slowly bent due to an external force, stress concentration at the interfaces between the macromolecular matrix and the piezoelectric body particles in the maximum bending moment portion is relaxed, and high flexibility can be expected.

In addition, the storage elastic modulus (E') of the macromolecular material at a frequency of 1 Hz by a dynamic viscoelastic test is preferably 100 MPa or more at 0° C. and 10 MPa or less at 50° C.

In such a case, it is possible to decrease the bending moment which is generated when the macromolecular composite piezoelectric body is slowly bent due to an external force, and the macromolecular composite piezoelectric body is capable of acting rigidly with respect to acoustic vibrations of 20 Hz to 20 kHz at the same time.

In addition, the relative permittivity at 25° C. of the macromolecular material is more preferably 10 or more. In such a case, when a voltage is applied to the macromolecular composite piezoelectric body, a higher electric field is applied to the piezoelectric body particles in the macromolecular matrix, and thus a large deformation amount can be expected.

However, on the other hand, the relative permittivity at 25° C. of the macromolecular material is preferably 10 or less in consideration of the ensuring of favorable moisture resistance and the like.

Examples of macromolecular materials that satisfy the above-described conditions include cyanoethylated polyvinyl alcohol (cyanoethylated PVA), polyvinyl acetate, polyvinylidene chloride-co-acrylironitrile, polystyrene-vinyl polyisoprene block copolymers, polyvinyl methyl ketone, polybutyl methacrylate, and the like. In addition, as the macromolecular material, it is also possible to preferably use commercially available products such as HYBRAR 5127 (manufactured by Kuraray Co., Ltd.). Among these, materials having a cyanoethyl group are preferably used, and cyanoethylated PVA is particularly preferably used.

Meanwhile, only one type of macromolecular material may be used or a plurality of types of macromolecular materials may be used jointly (in a mixed form).

In the viscoelastic matrix 24 in which the above-described macromolecular material that is viscoelastic at normal temperature is used, a plurality of macromolecular materials may be jointly used as necessary.

That is, to the viscoelastic matrix 24, for the purpose of the adjustment of the dielectric characteristic or the mechanical characteristic and the like, in addition to the viscoelastic material such as cyanoethylated PVA, other dielectric macromolecular materials may be added as necessary.

Examples of dielectric macromolecular materials that can be added include fluorine-based macromolecules such as polyvinylidene fluoride, vinylidene fluoride-tetrafluoroethylene copolymers, vinylidene fluoride-trifluoroethylene copolymers, polyvinylidene fluoride-trifluoroethylene copolymers, and polyvinylidene fluoride-tetrafluoroethylene copolymers, polymers having a cyano group or a cyanoethyl group such as vinylidene cyanide-vinyl acetate copolymers, cyanoethyl cellulose, cyanoethyl hydroxysucrose, cyanoethyl hydroxycellulose, cyanoethyl hydroxypullulan, cyanoethyl methacrylate, cyanoethyl acrylate, cyanoethyl hydroxyethyl cellulose, cyanoethyl amylose, cyanoethyl hydroxypropyl cellulose, cyanoethyl dihydroxypropyl cellulose, cyanoethyl hydroxypropyl amylose, cyanoethyl polyacrylamide, cyanoethyl polyacrylate, cyanoethyl pullulan, cyanoethyl polyhydroxymethylene, cyanoethyl glycidol pullulan, cyanoethyl sucrose, and cyanoethyl sorbitol, synthetic rubber such as nitrile rubber and chloroprene rubber, and the like.

Among these, macromolecular materials having a cyanoethyl group are preferably used.

In addition, the number of the types of the dielectric polymer that is added to the viscoelastic matrix 24 in the piezoelectric body layer 12 in addition to the material that is viscoelastic at normal temperature such as cyanoethylated PVA is not limited to one, and a plurality of types of dielectric polymers may be added thereto.

Additionally, in addition to the dielectric polymer, for the purpose of adjusting the glass transition temperature Tg, a thermoplastic resin such as a vinyl chloride resin, polyethylene, polystyrene, a methacrylic resin, polybutene, or isobutylene or a thermosetting resin such as a phenolic resin, a urea resin, a melamine resin, an alkyd resin, or mica may also be added thereto.

Furthermore, for the purpose of improving the pressure-sensitive adhesiveness, a tackifier such as a rosin ester, rosin, terpene, terpene phenol, or a petroleum resin may also be added thereto.

When the polymer other than the viscoelastic material such as cyanoethylated PVA is added to the viscoelastic matrix 24 in the piezoelectric body layer 12, the amount of the polymer added is not particularly limited, but is preferably set to 30% by weight or less in terms of the proportion of the polymer in the viscoelastic matrix 24.

In such a case, there are no cases in which the viscoelastic relaxation mechanism in the viscoelastic matrix 24 is impaired, and it is possible to develop the characteristics of the macromolecular material being added, and thus it is possible to obtain preferred results such as an increase in the permittivity, the improvement of the heat resistance, and the improvement of the adhesiveness to the piezoelectric body particles 26 or electrode layers.

In addition, for the purpose of increasing the permittivity of the piezoelectric body layer 12, dielectric body particles may also be added to the viscoelastic matrix 24.

The dielectric body particles are made of particles having a high relative permittivity of 80 or higher at 25° C.

Examples of the dielectric body particles include lead zirconate titanate (PZT), barium titanate ($BaTiO_3$), titanium oxide ($TiO_2$), strontium titanate ($SrTiO_3$), lead lanthanum zirconate titanate (PLZT), zinc oxide (ZnO), solid solutions (BFBT) of barium titanate and bismuth ferrite ($BiFe^3$), and the like. Among these, barium titanate ($BaTiO_3$) is preferably used as the dielectric particles due to the high relative permittivity.

The average particle diameter of the dielectric particles is preferably 0.5 μm or less.

In addition, the volume fraction of the dielectric particles in the total volume of the viscoelastic matrix and the dielectric particles is preferably 5% to 45%, more preferably 10% to 30%, and particularly preferably 20% to 30%.

The piezoelectric body particles 26 are made of ceramic particles having a perovskite-type or wurtzite-type crystal structure.

Examples of the ceramic particles constituting the piezoelectric body particles 26 include lead zirconate titanate (PZT), lead lanthanum zirconate titanate (PLZT), barium titanate ($BaTiO_3$), zinc oxide (ZnO), solid solutions (BFBT) of barium titanate and bismuth ferrite ($BiFeO_3$), and the like.

Meanwhile, only one type of ceramic particles may be used or a plurality of types of ceramic particles may be jointly used.

The particle diameter of the piezoelectric body particle 26 as described above may be appropriately selected depending on the size or application of the conversion film 10; however, according to the present inventors' studies, the particle diameter is preferably 1 to 10 μm.

In a case in which the particle diameter of the piezoelectric body particle 26 is in the above-described range, it is possible to obtain preferred results such as the possibility of the satisfaction of both high piezoelectric characteristics and flexibility and the possibility of the improvement of the voltage resistance.

Meanwhile, in FIG. 3, the piezoelectric body particles 26 in the piezoelectric body layer 12 are uniformly and regularly dispersed in the viscoelastic matrix 24, but the present invention is not limited thereto.

That is, the piezoelectric body particles 26 may be irregularly dispersed in the viscoelastic matrix 24 as long as the piezoelectric body particles are, preferably, uniformly dispersed in the piezoelectric body layer 12.

In the conversion film 10, the quantitative ratio between the viscoelastic matrix 24 and the piezoelectric body particles 26 in the piezoelectric body layer 12 may be appropriately set depending on the size or thickness of the conversion film 10 in the surface direction, the application of the conversion film 10, characteristics required for the conversion film 10, and the like.

Here, according to the present inventors' studies, the volume fraction of the piezoelectric body particles 26 in the piezoelectric body layer 12 is preferably 30% to 70% and, particularly, is preferably set to 50% or more, and thus more preferably set to 50% to 70%.

In a case in which the quantitative ratio between the viscoelastic matrix 24 and the piezoelectric body particles 26 is set in the above-described range, it is possible to obtain preferred results such as the possibility of the satisfaction of both high piezoelectric characteristics and flexibility.

In addition, in the conversion film 10, the thickness of the piezoelectric body layer 12 is also not particularly limited and may be appropriately set depending on the size of the conversion film 10, the application of the conversion film 10, characteristics required for the conversion film 10, and the like.

Here, according to the present inventors' studies, in a case in which the thickness of the piezoelectric body layer 12 is set to be thin, the piezoelectric body layer being bent due to the weight is alleviated, and, in a case in which the thickness is set to be lightweight, the followability of the piezoelectric film with respect to applied voltage is improved, and thus it is possible to improve acoustic pressure or audio quality. In addition, flexibility can be imparted. On the other hand, in a case in which the thickness of the piezoelectric body layer 12 is too thin, there is a concern that, when stiffness continuously applies a voltage or a high voltage, local short-circuits may be caused. In addition, there is a concern that the stiffness may degrade.

From the above-described viewpoint, the thickness of the piezoelectric body layer 12 is preferably 5 μm to 100 μm, more preferably 8 μm to 50 μm, particularly, still more preferably 10 μm to 40 μM, and particularly preferably 15 μm to 25 μm.

Meanwhile, as described above, the piezoelectric body layer 12 is preferably subjected to a polarization treatment (polling). The polarization treatment will be described below in detail.

As illustrated in FIG. 3, the conversion film 10 has a constitution obtained by forming the lower portion thin film electrode 14 on one surface of the above-described piezoelectric body layer 12, forming the lower portion protective layer 18 thereon, forming the upper portion thin film electrode 16 on the other surface of the piezoelectric body layer 12, and forming the upper portion protective layer 20 thereon. Here, the upper portion thin film electrode 16 and the lower portion thin film electrode 14 form an electrode pair.

Meanwhile, in addition to the above-described layers, the conversion film 10 may further have electrode extraction portions that extract electrodes from the upper portion thin film electrode 16 and the lower portion thin film electrode 14, an insulating layer that covers regions in which the piezoelectric body layer 12 is exposed and prevents short-circuits or the like, and the like.

The electrode extraction portion may be provided at a portion in which the thin film electrode and the protective layer protrude in a convex shape toward the outside of the piezoelectric body layer in the surface direction or the electrode extraction portion may be produced by removing a part of the protective layer so as to form a hole portion and inserting a conductive material such as silver paste into this hole portion so as to electrically connect the conductive material and the thin film electrode.

Meanwhile, the number of the electrode extraction portions in each of the thin film electrodes is not limited to one and may be two or more. Particularly, in the case of a constitution in which the electrode extraction portion is produced by removing a part of the protective layer and inserting a conductive material into the hole portion, the number of the electrode extraction portions is preferably three or more in order to more reliably ensure electric connection.

The conversion film 10 has a constitution obtained by sandwiching both surfaces of the piezoelectric body layer 12 with the electrode pair, that is, the upper portion thin film electrode 16 and the lower portion thin film electrode 14 and sandwiching this laminate with the upper portion protective layer 20 and the lower portion protective layer 18.

A region sandwiched by the upper portion thin film electrode 16 and the lower portion thin film electrode 14 is driven depending on applied voltage.

In the conversion film 10, the upper portion protective layer 20 and the lower portion protective layer 18 play a role of covering the upper portion thin film electrode 16 and the lower portion thin film electrode 14 and imparting appropriate stiffness and mechanical strength to the piezoelectric body layer 12. That is, in the conversion film 10 of the present invention, the piezoelectric body layer 12 made up of the viscoelastic matrix 24 and the piezoelectric body particles 26 exhibits extremely excellent flexibility with respect to slow-phased bending deformation; however, depending on applications, there are cases in which the piezoelectric body layer is not satisfactory in terms of stiffness or mechanical strength. The conversion film 10 is provided with the upper portion protective layer 20 and the lower portion protective layer 18 in order to compensate for stiffness or mechanical strength.

Meanwhile, the lower portion protective layer 18 and the upper portion protective layer 20 are different only in terms of the disposition location, but have the same constitution, and thus, in the following description, both members will be collectively referred to as the protective layers except for cases in which it is necessary to differentiate the lower portion protective layer 18 and the upper portion protective layer 20.

The upper portion protective layer 20 and the lower portion protective layer 18 are not particularly limited, a variety of sheet-like substances can be used, and, as an example, a variety of resin films are preferably exemplified. Among them, polyethylene terephthalate (PET), polypropylene (PP), polystyrene (PS), polycarbonate (PC), polyphenylene sulfide (PPS), polymethyl methacrylate (PMMA), polyether imide (PEI), polyimide (PI), polyamide (PA, aramid), polyethylene naphthalate (PEN), triacetyl cellulose (TAC), and cyclic olefin-based resins are preferably used since these resin films have excellent mechanical characteristics and heat resistance.

Among these, polyamide, polyimide, polyether imide, polycarbonate, and triacetyl cellulose are preferably used since excellent heat resistance is exhibited at a glass transition temperature Tg of 150° C. or higher. In such a case, it is possible to prevent appearance damage caused by the generation of heat during the application of voltage or the protective layer is capable of withstanding shelf tests and driving tests at a high temperature.

The thicknesses of the upper portion protective layer 20 and the lower portion protective layer 18 are not also particularly limited. In addition, the thicknesses of the upper portion protective layer 20 and the lower portion protective layer 18 are, basically, the same as each other, but may be different from each other.

Here, in a case in which the stiffness of the upper portion protective layer 20 and the lower portion protective layer 18 is too high, the extension and contraction of the piezoelectric body layer 12 is restrained or the flexibility is also impaired, and thus it becomes more advantages as the upper portion protective layer 20 and the lower portion protective layer 18 become thinners except for cases in which mechanical strength or favorable handleability as sheet-like substances is required.

According to the present inventors' studies, in a case in which the thicknesses of the upper portion protective layer 20 and the lower portion protective layer 18 are twice or more the thickness of the piezoelectric body layer 12, it is possible to obtain preferred results such as the satisfaction of both the ensuring of stiffness and appropriate flexibility.

For example, in a case in which the thickness of the piezoelectric body layer 12 is 20 μm and the upper portion protective layer 20 and the lower portion protective layer 18 are made of PET, the thicknesses of the upper portion protective layer 20 and the lower portion protective layer 18 are preferably 40 μm or less and more preferably 20 μm or less, and, among these, is preferably set to 15 μm or less.

In the conversion film 10, the upper portion thin film electrode (hereinafter, also referred to as the upper portion electrode) 16 is formed between the piezoelectric body layer 12 and the upper portion protective layer 20, and the lower portion thin film electrode (hereinafter, also referred to as the lower portion electrode) 14 is formed between the piezoelectric body layer 12 and the lower portion protective layer 18.

The upper portion electrode 16 and the lower portion electrode 14 are provided to apply an electric field to the conversion film 10 (piezoelectric body layer 12).

Meanwhile, the lower portion electrode 14 and the upper portion electrode 16 are different only in terms of the size and the disposition location, but have the same constitution, and thus, in the following description, both members will be collectively referred to as the thin film electrodes except for cases in which it is necessary to differentiate the lower portion electrode 14 and the upper portion electrode 16.

In the present invention, materials for forming the upper portion electrode 16 and the lower portion electrode 14 are not particularly limited, and it is possible to use a variety of conductors. Specific examples thereof include carbon, palladium, iron, tin, aluminum, nickel, platinum, gold, silver, copper, chromium, molybdenum, and the like, alloys thereof, indium tin oxide, and the like. Among these, any of copper, aluminum, gold, silver, platinum, and indium tin oxide is preferably exemplified.

In addition, methods for forming the upper portion electrode 16 and the lower portion electrode 14 are also not particularly limited, and it is possible to use a variety of well-known methods such as vapor-phase deposition methods (vacuum film-forming methods) such as vacuum deposition and sputtering, film formation by means of plating, and methods in which a foil formed of the above-described material is attached.

Among these, copper or aluminum thin films formed by vacuum deposition are preferably used as the upper portion electrode 16 and the lower portion electrode 14 since it is possible to ensure the flexibility of the conversion film 10. Among these, particularly, copper thin films formed by vacuum deposition are preferably used.

The thicknesses of the upper portion electrode 16 and the lower portion electrode 14 are not particularly limited. In addition, the thicknesses of the upper portion electrode 16 and the lower portion electrode 14 are, basically, the same as each other, but may be different from each other.

Here, similar to the upper portion protective layer 20 and the lower portion protective layer 18, in a case in which the stiffness of the upper portion electrode 16 and the lower portion electrode 14 is too high, the extension and contraction of the piezoelectric body layer 12 is restrained or the flexibility is also impaired, and thus it becomes more advantages as the upper portion electrode 16 and the lower portion electrode 14 become thinners as long as the electric resistance does not become too high.

Here, according to the present inventors' studies, the product of the thickness and Young's modulus of the upper portion electrode 16 and the lower portion electrode 14 is preferably smaller than the product of the thickness and Young's modulus of the upper portion protective layer 20 and the lower portion protective layer 18 since there are no cases in which the flexibility is significantly impaired.

For example, in the case of a combination of the upper portion protective layer 20 and the lower portion protective layer 18 being made of PET (Young's modulus: approximately 6.2 GPa) and the upper portion electrode 16 and the lower portion electrode 14 being made of copper (Young's modulus: approximately 130 GPa), in a case in which the thicknesses of the upper portion protective layer 20 and the lower portion protective layer 18 are assumed to be 25 μm, the thicknesses of the upper portion electrode 16 and the lower portion electrode 14 are preferably 1.2 μm or less and more preferably 0.3 μm or less and are preferably set to, among these, 0.1 μm or less.

In addition, the thin film electrode does not need to be formed on the entire surface of the piezoelectric body layer 12 (the lower portion protective layer 18 and/or the upper portion protective layer 20).

That is, the conversion film may have a constitution in which at least one of the thin film electrodes is, for example, smaller than the piezoelectric body layer 12 and the piezoelectric body layer 12 and the protective layer are in direct contact with each other in the peripheral portion of the conversion film 10.

Alternatively, the protective layer having the thin film electrode formed on the entire surface does not need to be formed on the entire surface of the piezoelectric body layer 12. In this case, the conversion film may have a constitution in which the second protective layer in direct contact with the piezoelectric body layer 12 is separately provided on the surface side of the protective layer.

In addition, the conversion film may be provided with a constitution in which coating layers are further provided for the purpose of improvement in the adhesive force between the thin film electrodes and the piezoelectric body layer 12, improvement in flexibility, and the like. In this case, the coating layer may be formed onto any of the thin film electrode or the piezoelectric body layer 12.

In this case, as a macromolecular component, it is possible to use a thermoplastic resin such as poly(meth)acrylate, polyurethane, polyester, polyolefin, PVA, or polystyrene or a thermosetting resin such as a phenolic resin or a melamine resin. Among these, dielectric macromolecules are preferably used in order to improve acoustic performance. Specifically, the above-described macromolecules and the like can be preferably used. Additionally, in addition to the macromolecular component, high dielectric body particles, an antistatic agent, a surfactant, a viscosity improver, a crosslinking agent, and the like may also be added thereto.

In addition, in the example illustrated in the drawings, the layer constitution of the conversion film 10 is a constitution in which the piezoelectric body layer 12, the lower portion thin film electrode 14 laminated on one surface of the piezoelectric body layer 12, the lower portion protective layer 18 laminated on the lower portion thin film electrode 14, the upper portion thin film electrode 16 laminated on the other surface of the piezoelectric body layer 12, the upper portion protective layer 20 laminated on the upper portion thin film electrode 16 are provided, but the layer constitution is not limited thereto, and the conversion film may further have, in addition to the above-described layers, for example, an insulating layer that covers regions in which the piezoelectric body layer 12 is exposed and prevents short-circuits or the like, a coloring layer that coats the thin film electrode, or the like.

For example, in a case in which the coloring layer is provided, the layer constitution may be a constitution in which the piezoelectric body layer 12, the lower portion thin film electrode 14 laminated on one surface of the piezoelectric body layer 12, a lower portion coloring layer laminated on the lower portion thin film electrode 14, the lower portion protective layer 18 laminated on the lower portion coloring layer, the upper portion thin film electrode 16 laminated on the other surface of the piezoelectric body layer 12, an upper portion coloring layer laminated on the upper portion thin film electrode 16, and the upper portion protective layer 20 laminated on the upper portion coloring layer are provided.

In a case in which the coloring layer is provided, it is possible to prevent rust on the upper portion thin film electrode 16 and the lower portion thin film electrode 14 from becoming recognizable from the outside.

From the viewpoint of preventing rust on the thin film electrodes from becoming recognizable from the outside, the transmission density of the coloring layer is preferably 0.3 or higher and more preferably 0.5 or higher.

Meanwhile, the transmission density refers to an optical density measured as the ratio of transmitted light to incident light, and the transmittance at a transmission density of 0.3 is approximately 50%, and the transmittance at a transmission density of 0.5 is approximately 30%.

In addition, the thickness of the coloring layer is preferably 1 μm or less and more preferably 100 nm or less and is particularly preferably set to, among these, 40 nm or less.

In addition, the electric resistance of the coloring layer is preferably low and is preferably $1\times10^{-7}$ Ω·m or less.

Materials for forming the coloring layers are not particularly limited as long as the materials satisfy the above-described transmission density and do not change in color due to rust and the like.

Specific examples of the materials for forming the coloring layers include metal such as indium, nickel, titanium, aluminum, gold, platinum, and chromium, inorganic pigments such as carbon black (CB), titanium oxide, zinc oxide, and barium sulfate; organic pigments such as quinacridone-based pigments, azo-based pigments, benzimidazolone-based pigments, phthalocyanine-based pigments, and anthraquinone-based pigments; light-scattering members having pores therein, and the like.

From the viewpoint of the above-described transmission density, thickness, and electric resistivity, metals are preferably used as the material for forming the coloring layer, and, among these, nickel is more preferred.

In addition, methods for forming the coloring layer are not particularly limited, and the coloring layer may be formed using a variety of well-known methods depending on the above-described materials.

For example, in a case in which metal is used as the material for forming the coloring layer, it is possible to use vapor-phase deposition methods (vacuum film-forming methods) such as vacuum deposition and sputtering, film formation by means of plating, methods in which a foil formed of the above-described material is attached, or the like. Since the coloring layer can be formed to be thinner, the coloring layer is more preferably formed by means of vacuum deposition.

In addition, in a case in which a pigment is used as the material for forming the coloring layer, it is possible to use a coating method, printing, and the like.

In addition, a method in which a previously-formed coloring layer is transferred can also be used.

In addition, the constitution in which the coloring layers are provided on the upper portion electrode 16 side and the lower portion electrode 14 side respectively is not limited and may be a constitution in which the coloring layer is provided on at least one of the electrode sides.

As described above, the conversion film 10 has a constitution formed by sandwiching the piezoelectric body layer 12 formed by dispersing the piezoelectric body particles 26 in the viscoelastic matrix 24 containing a macromolecular material that is viscoelastic at normal temperature with the upper portion electrode 16 and the lower portion electrode 14 and furthermore sandwiching the laminate with the upper portion protective layer 20 and the lower portion protective layer 18.

In the above-described conversion film 10, the maximum value at which the loss tangent (Tan δ) at a frequency of 1 Hz by dynamic viscoelastic measurement reaches 0.1 or more is preferably present at normal temperature.

In such a case, even in the case of being subjected to a relatively slow-phased and large external bending deformation of several hertz or less, the conversion film 10 is capable of effectively diffusing strain energy to the outside as heat, and thus it is possible to prevent the generation of cracks in the interfaces between the macromolecular matrix and the piezoelectric body particles.

In the conversion film 10, the storage elastic modulus (E') at a frequency of 1 Hz by dynamic viscoelastic measurement is preferably 10 to 30 GPa at 0° C. and 1 to 10 GPa at 50° C.

In such a case, it is possible for the conversion film 10 to have a large frequency dispersion in the storage elastic modulus (E') at normal temperature. That is, the conversion film is capable of acting rigidly with respect to vibrations of 20 Hz to 20 kHz and acting softly with respect to slow vibrations of several hertz or less.

In addition, in the conversion film 10, the product of the thickness and the storage elastic modulus (E') at a frequency of 1 Hz by dynamic viscoelastic measurement is preferably $1.0\times10^6$ to $2.0\times10^6$ (1.0 E+06 to 2.0 E+06) N/m at 0° C. and $1.0\times10^5$ to $1.0\times10^6$ (1.0 E+05 to 1.0 E+06) N/m at 50° C.

In such a case, the conversion film 10 can be provided with appropriate stiffness and mechanical strength while preventing the flexibility and the acoustic characteristics from being impaired.

Furthermore, for the conversion film 10, in a master curve obtained by dynamic viscoelastic measurement, the loss tangent (Tan δ) at 25° C. and a frequency of 1 kHz is preferably 0.05 or more.

In such a case, the frequency characteristics of a speaker for which the conversion film 10 is used becomes flat, and it is also possible to decrease the amount of audio quality changed during a change in the lowest resonance frequency $f_0$ caused by a change in the curvature of the speaker.

Next, an example of a method for manufacturing the conversion film 10 will be described with reference to FIG. 4A to FIG. 4E.

Figure 4A:
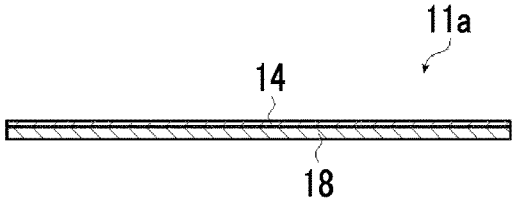
FIG. 4A is a conceptual view for describing an example of a method for producing the electroacoustic conversion film.

First, as illustrated in FIG. 4A, a sheet-like substance 11*a* having the lower portion electrode 14 formed on the lower portion protective layer 18 is prepared. This sheet-like substance 11*a* may be produced by forming a copper thin film or the like as the lower portion electrode 14 on the surface of the lower portion protective layer 18 by means of vacuum deposition, sputtering, plating, or the like.

The lower portion protective layer 18 is extremely thin, and, when the handleability is poor or the like, a separator (temporary support)-attached lower portion protective layer 18 may be used as necessary. Meanwhile, as the separator, it is possible to use a 25 to 100 μm-thick PET or the like. The separator needs to be removed after the thermal compression of the thin film electrode and the protective layer and immediately before the formation of a side surface insulating layer, a second protective layer, or the like.

Alternatively, commercially available products having a copper thin film or the like formed on the lower portion protective layer 18 may also be used as the sheet-like substance 11*a*.

Meanwhile, paint is prepared by dissolving a macromolecular material having a cyanoethyl group such as cyanoethylated PVA (hereinafter, also referred to as the viscoelastic material) in an organic solvent, furthermore, adding the piezoelectric body particles 26 such as PZT particles thereto, and dispersing the piezoelectric body particles by means of stirring. The organic solvent is not particularly limited, and it is possible to use a variety of organic solvents such as dimethylformamide (DMF), methyl ethyl ketone, and cyclohexanone.

Once the sheet-like substance 11*a* is prepared, and the paint is prepared, the paint is cast (applied) to the sheet-like substance, and the organic solvent is evaporated and dried. Therefore, a laminate 11*b* having the lower portion electrode 14 on the lower portion protective layer 18 and having the piezoelectric body layer 12 on the lower portion electrode 14 as illustrated in FIG. 4B is produced.

A method for casting the paint is not particularly limited, and it is possible to use all of well-known methods (coating apparatuses) such as a slide coater or a doctor knife.

Figure 4B:
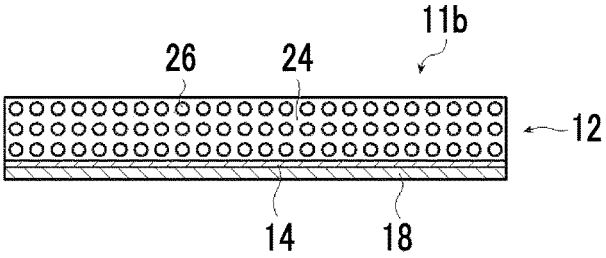
FIG. 4B is a conceptual view for describing an example of the method for producing the electroacoustic conversion film.

Alternatively, in a case in which the viscoelastic material is a substance that can be heated and melted such as cyanoethylated PVA, the laminate 11*b* having the lower portion electrode 14 on the lower portion protective layer 18 and having the piezoelectric body layer 12 on the lower portion electrode 14 as illustrated in FIG. 4B may also be produced by producing a molten substance by heating and melting the viscoelastic material and adding/dispersing the added macromolecular material and the piezoelectric body particles 26 to/in the viscoelastic material, extruding the molten substance in a sheet shape onto the sheet-like substance 11*a* illustrated in FIG. 4A by means of extrusion molding or the like, and cooling the molten substance.

Meanwhile, as described above, in the conversion film 10, not only the viscoelastic material such as cyanoethylated PVA but also a macromolecular piezoelectric material such as PVDF may be added to the viscoelastic matrix 24.

During the addition of the macromolecular piezoelectric material to the viscoelastic matrix 24, the macromolecular piezoelectric material that is to be added to the paint needs to be dissolved. Alternatively, the macromolecular piezoelectric material that is to be added needs to be added to the heated and melted viscoelastic material and then heated and melted.

Once the laminate 11*b* having the lower portion electrode 14 on the lower portion protective layer 18 and having the piezoelectric body layer 12 on the lower portion electrode 14 is produced, a polarization treatment (polling) is preferably carried out on the piezoelectric body layer 12.

A method for the polarization treatment of the piezoelectric body layer 12 is not particularly limited, and it is possible to use well-known methods. As a method for a preferred polarization treatment, a method illustrated in FIG. 4C and FIG. 4D is exemplified.

Figure 4C:
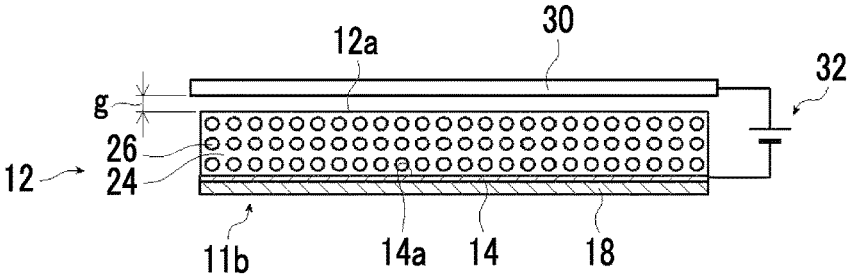
FIG. 4C is a conceptual view for describing an example of the method for producing the electroacoustic conversion film.
Figure 4D:
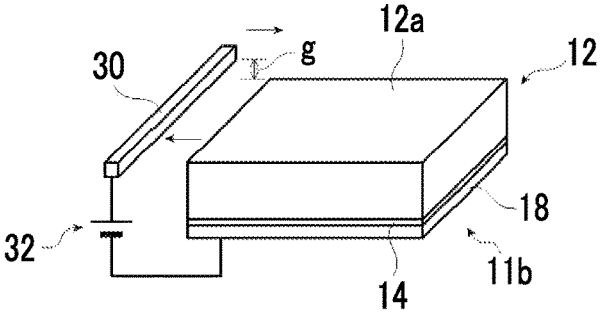
FIG. 4D is a conceptual view for describing an example of the method for producing the electroacoustic conversion film.

In this method, as illustrated in FIG. 4C and FIG. 4D, a rod-like or wire-like corona electrode 30 capable of moving along an upper surface 12*a* is provided on the upper surface 12*a* of the piezoelectric body layer 12 in the laminate 11*b* at an interval g of, for example, 1 mm. In addition, the corona electrode 30 and the lower portion electrode 14 are connected to a direct-current power supply 32.

Furthermore, heating means for heating and holding the laminate 11*b*, for example, a hot plate is prepared.

After that, in a state in which the piezoelectric body layer 12 is heated to and held at a temperature of, for example, 100° C. using heating means, a direct-current voltage of several kilovolts, for example, 6 kV is applied between the lower portion electrode 14 and the corona electrode 30 from the direct-current power supply 32 so as to cause corona discharging. Furthermore, in a state of maintaining the gap g, the corona electrode 30 is moved (scanned) along the upper surface 12*a* of the piezoelectric body layer 12, thereby carrying out the polarization treatment of the piezoelectric body layer 12.

In the polarization treatment using the above-described corona discharging (hereinafter, also referred to as the corona polling treatment), the corona electrode 30 may be moved using well-known moving means for rod-like substances.

In addition, in the corona polling treatment, a method for moving the corona electrode 30 is not also particularly limited. That is, the polarization treatment may be carried out by fixing the corona electrode 30, providing a moving mechanism for moving the laminate 11*b*, and moving the laminate 11*b*. The laminate 11*b* may also be moved using well-known moving means for sheet-like substances.

Furthermore, the number of the corona electrodes 30 is not limited to one, and the corona polling treatment may be carried out using a plurality of corona electrodes 30.

In addition, the polarization treatment is not limited to the corona polling treatment, and ordinary electric field polling in which a direct-current electric field is directly applied to a subject of the polarization treatment can also be used. However, in a case in which the ordinary electric field polling is carried out, the upper portion electrode 16 needs to be formed before the polarization treatment.

Meanwhile, a calender treatment in which the surface of the piezoelectric body layer 12 is flattened using a heating roller or the like may also be carried out before the polarization treatment. This calender treatment enables thermal compression described below to be smoothly carried out.

The polarization treatment of the piezoelectric body layer 12 in the laminate 11*b* is carried out in the above-described manner, and simultaneously, a sheet-like substance 11*c* having the upper portion electrode 16 formed on the upper portion protective layer 20 is prepared. This sheet-like substance 11*c* may be produced by forming a copper thin film or the like as the upper portion electrode 16 on the surface of the upper portion protective layer 20 by means of vacuum deposition, sputtering, plating, or the like.

Figure 4E:
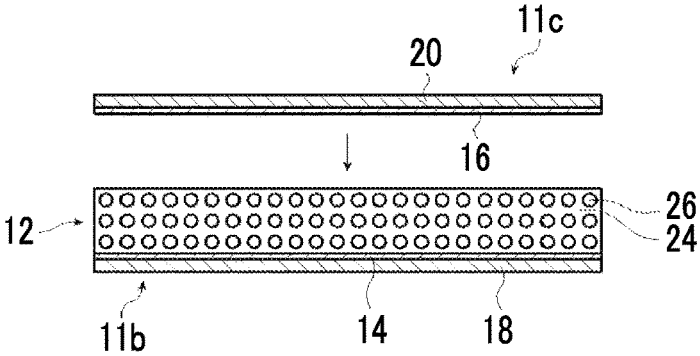
FIG. 4E is a conceptual view for describing an example of the method for producing the electroacoustic conversion film.

Next, as illustrated in FIG. 4E, the sheet-like substance 11*c* is laminated on the laminate 11*b* in which the polarization treatment of the piezoelectric body layer 12 has been completed so that the upper portion electrode 16 faces the piezoelectric body layer 12.

Furthermore, a laminate of the laminate 11*b* and the sheet-like substance 11*c* is thermally compressed using a heating pressing machine, a heating roller pair, or the like so as to sandwich the upper portion protective layer 20 and the lower portion protective layer 18, thereby producing the conversion film 10.

The above-described conversion film 10 may be manufactured using the sheet-like substance having a cut-sheet shape or in a roll-to-roll manner (hereinafter, also referred to as RtoR).

As well known, RtoR refers to a manufacturing method in which a raw material is extracted from a roll formed by winding the long raw material, a variety of treatments such as film formation or a surface treatment are carried out on the raw material while transporting the raw material in the longitudinal direction, and the raw material on which the treatments have been completed is again wound in a roll shape.

As described above, in the video audio system 100 illustrated in FIG. 1A and FIG. 1B, the plurality of conversion units 40 is arranged on the rear surface side of the above-described display device 102.

Specifically, in the video audio system 100 illustrated in FIG. 1A and FIG. 1B, 40 conversion units 40 are arranged in a matrix form of five rows and eight columns almost equally throughout the entire rear surface in the surface direction of the rear surface of the display device 102.

In addition, each of the conversion units 40 is disposed so that the conversion film 10 side (vibration region side) that generates sound faces the rear surface of the display device 102.

Meanwhile, the plurality of conversion units 40 needs to be arranged in regions in the display device 102 on which videos are displayed in the surface direction.

Sound data that are input to the plurality of conversion units 40 arranged as described above include the location information of the conversion units 40, and the sound data are input on the basis of videos that are displayed on the display device, whereby sound is generated in synchronization with the videos.

Specifically, in the surface direction of a video-displaying surface of the display device 102, the data of sound that is generated from a substance that serves as the generation source of the sound are input to the conversion units 40 disposed at locations at which the substance that serves as the generation source of the sound is displayed on videos displayed on the display device 102, and the conversion units 40 generate the sound that is generated from the substance that serves as the generation source of the sound.

For example, in the case of a video in which a human being produces a sound, the data of the sound that this human being produces is input to the conversion unit 40 disposed at a location of the face (or mouth) of the human being that produces the sound, and the conversion unit 40 reproduces a voice that the human being produces.

In addition, in a case in which the substance that serves as the generation source of sound moves on a video that is displayed on the display device 102, sound data are input to individual conversion units 40 so that the conversion units 40 that generate sound are sequentially changed in synchronization with the movement of the substance that serves as the generation source of the sound.

As described above, in acoustic systems in which a virtual sound source is set using a plurality of speakers and a state in which sound is generated from the virtual sound source is reproduced, there is a problem in that the virtual sound source is not appropriately reproduced depending on viewer's locations, locations do not match between videos and the sound source, which disables the position assignment of sound, and a sufficient realistic feeling cannot be obtained.

In addition, with speakers alone that are disposed on the rear surface side of a display device, it is not possible to impart a sufficient stereoscopic effect to sound, and the realistic feeling is not sufficient.

In contrast, in the video audio system of the present invention, as described above, sound data that are input to the plurality of conversion units 40 include the location information of the conversion units 40, the data of sound that is generated from a substance that serves as the generation source of the sound are input to the conversion units 40 disposed at locations at which the substance that serves as the generation source of the sound is displayed on videos that are displayed on the display device 102, and the conversion units 40 generate the sound that is generated from the substance that serves as the generation source of the sound, and thus videos and sound source locations match each other, and a sufficient realistic feeling can be obtained.

Here, in a case in which sound that is generated from a substance that serves as a generation source of the sound is reproduced using the conversion units 40 disposed at the location of the substance that serves as the generation source of the sound on a video that is displayed on the display device 102 as described above, it is necessary to dispose the conversion units 40 in the entire region of the display device 102 in which the video is displayed, and thus it is necessary to arrange a plurality of the conversion units 40 at a high density so as to cover the entire region in which the video is displayed.

However, in a case in which a plurality of speakers is arranged at a high density so as to cover the entire region in which videos are displayed using corn speakers of the related art, piezoelectric speakers for which an ordinary piezoelectric film is used, or the like, the distance between the speakers becomes close, and thus there is a problem in that adjacent speakers influence each other and crosstalk occurs.

In addition, in corn speakers of the related art, the shape of a vibration plate in the surface direction is a circular shape, and thus it is not possible to arrange vibration regions which are substantially regions from which sound is generated at a high density, and there are cases in which it is not possible to generate sound from a location at which a substance that serves as a generation source of sound is displayed, and thus there are cases in which location misalignment is caused between sound and videos.

In contrast, in the present invention, as described above, the conversion units 40 in which the conversion film 10 having the macromolecular composite piezoelectric body formed by dispersing the piezoelectric body particles in the viscoelastic matrix formed of the macromolecular material that is viscoelastic at normal temperature and the thin film electrodes sandwiching the macromolecular composite piezoelectric body is used as a vibration plate are used, and thus, even in a case in which the plurality of conversion units 40 is disposed in the entire region in the display device 102 in which videos are displayed and thus the distance between the conversion units 40 becomes close, crosstalk is not easily caused, and the respective conversion units 40 are capable of appropriately reproducing sound.

In addition, in a case in which the above-described conversion film 10 is used as a vibration plate, it is possible to provide a square shape to the vibration region, and thus it is possible to arrange the vibration regions at a high density, and it is possible to appropriately generate sound from a location at which the substance that serves as the generation source of sound is displayed.

Therefore, the video audio system of the present invention is capable of reproducing sound that feels realistic.

In addition, the conversion unit 40 in which the above-described conversion film 10 is used as the vibration plate can be provided with a thinner thickness compared with corn speakers of the related art, and thus, even in a case in which the conversion units are combined with a thin-type display such as a liquid crystal display or an organic electro luminescence (EL) display, it is possible to reduce the entire thickness. In addition, the conversion unit 40 can be made to weigh less compared with a corn speaker of the related art, even in a case in which the conversion units are combined with a thin-type display, it is possible to reduce the weight.

Here, since it is possible to appropriately generate sound from the location in which the substance that serves as the generation source of sound is displayed, the proportion of the total area of the vibration regions in the plurality of conversion films 40 in the area of the region in the display device 102 on which videos are displayed is preferably 80% or more and more preferably 85% or more.

In addition, when sound that is generated from the substance that serves as the generation source of the sound is generated using the conversion units 40 disposed at the location of the substance that serves as the generation source of the sound on a video that is generated on the display device 102, the sound may be generated using one conversion unit 40 or the sound may also be generated using two or more conversion units 40.

For example, in a case in which the size of the substance that serves as the generation source of sound on a video is larger than that of one conversion unit 40, sound may be generated from two or more conversion units 40 present at the location at which the substance that serves as the generation source of the sound is displayed.

In addition, the number of the conversion units 40 that are arranged on the rear surface side of the display device 102 is not limited as long as the number is plural and may be appropriately set depending on the size of the display device 102, the size of the conversion unit 40, or the like.

Meanwhile, as the number of the conversion units 40 increases, it is possible to generate sound from the location of the substance that serves as the generation source of the sound at a higher accuracy, and it is possible to increase the so-called resolution of sound. Meanwhile, it is necessary to decrease the size of each of the conversion units 40 in order to increase the number of the conversion units 40; however, in a case in which the conversion unit 40 is too small, there is a concern that a problem of a reproducible bandwidth becoming narrow or the like may be caused.

Therefore, the number of the conversion units is preferably four or more.

In addition, the conversion units 40 may be disposed in contact with the rear surface of the display device 102 or may be disposed a predetermined distance away from the rear surface of the display device 102.

In addition, the sound data that are input to the conversion units 40 need to be imparted with the location information of conversion units to be reproduced in advance on the basis of video data.

In addition, the video data and the sound data may be provided in a state of being recorded in a variety of recording media such as a film, a hard disc drive, a flash memory, DVD, and a blue ray disc or may be provided through a communication circuit.

Here, the video audio system 100 illustrated in FIG. 1A is provided with the constitution in which one conversion unit 40 has one vibration region, but the constitution is not limited thereto, and the video audio system may be provided with a constitution in which the conversion unit 40 has a plurality of vibration regions.

Figure 5A:
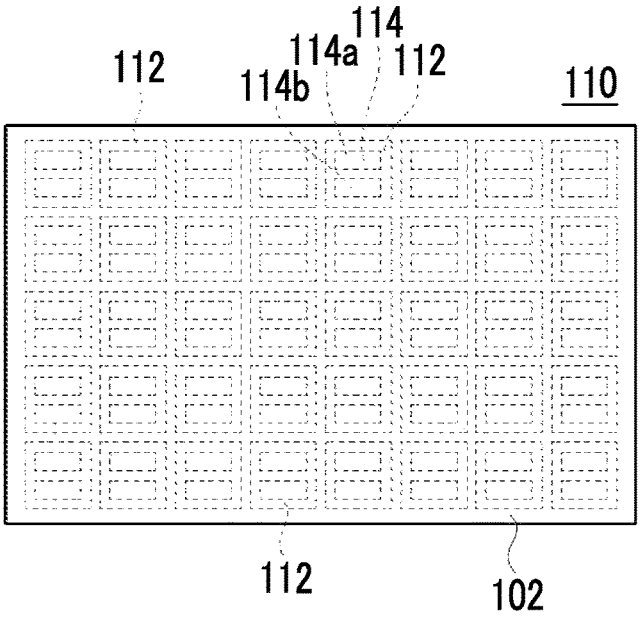
FIG. 5A is a front view conceptually illustrating another example of the video audio system of the present invention.
Figure 5B:
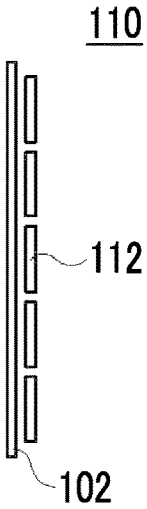
FIG. 5B is a side view of FIG. 5A.

An example is illustrated in FIG. 5A and FIG. 5B.

FIG. 5A is a front view conceptually illustrating another example of the video audio system of the present invention, and FIG. 5B is a side view of FIG. 5A.

A video audio system 110 illustrated in FIG. 5A and FIG. 5B has the display device 102 that displays videos and a plurality of conversion units 112 arranged throughout the entire rear surface side of the display device 102.

In the video audio system 110 exemplified in the drawings, 40 conversion units 112 are arranged in a matrix form of five rows and eight columns throughout the entire rear surface side of the display device 102.

The conversion unit 112 has the same constitution as the conversion unit 40 except for the fact that a conversion film 114 is provided instead of the conversion film 10.

Each of the conversion units 112 has two vibration regions 114*a* and 114*b*. That is, the video audio system 110 has 80 vibration regions arranged on the rear surface side of the display device 102.

Figure 6A:
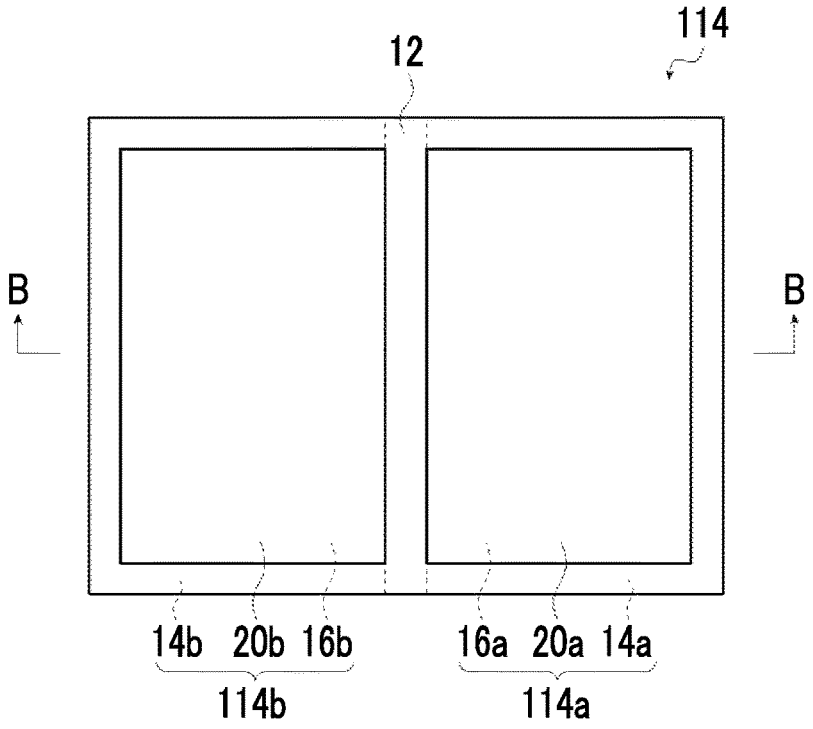
FIG. 6A is a top view schematically illustrating an example of an electroacoustic conversion film that is used in the video audio system of FIG. 5A.
Figure 6B:
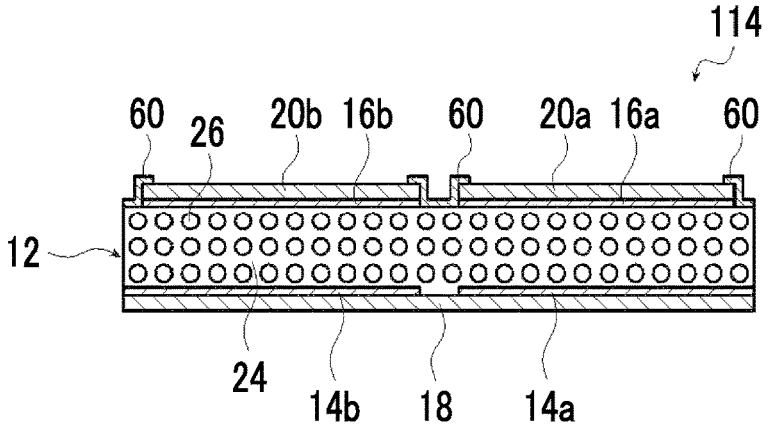
FIG. 6B is a cross-sectional view in a direction of a B-B line in FIG. 6A.

FIG. 6A is a top view schematically illustrating an example of the conversion film 114, and FIG. 6B is a cross-sectional view in a direction of a B-B line in FIG. 6A.

The conversion film 114 illustrated in FIG. 6A and FIG. 6B is constituted by having the piezoelectric body layer 12 which is a piezoelectric sheet-like substance, two upper portion thin film electrodes 16*a* and 16*b* which are formed on one surface (the upper surface in the example illustrated in the drawings) of the piezoelectric body layer 12, two upper portion protective layers 20*a* and 20*b* which are respectively formed on the upper portion thin film electrodes 16*a* and 16*b*, lower portion thin film electrodes 14*a* and 14*b* which are formed on a surface of the piezoelectric body layer 12 opposite to the upper portion thin film electrodes 16*a* and 16*b*, the lower portion protective layer 18 which is formed on the lower portion thin film electrodes 14*a* and 14*b* (the lower surface in FIG. 2), and a side surface insulating layer 60.

Meanwhile, in FIG. 6A, the side surface insulating layer 60 is not illustrated.

In addition, the conversion film 114 has the same constitution as the conversion film 10 except for the fact that the numbers of the upper portion thin film electrodes, the lower portion thin film electrodes, and the upper portion protective layers are respectively two, and thus the same portion will be given the same reference sign, and, in the following description, different portions will be mainly described.

As illustrated in the drawings, the conversion film 114 has a constitution obtained by forming the first upper portion thin film electrode 16*a* and the second upper portion thin film electrode 16*b* on one surface of the piezoelectric body layer 12, respectively forming the first upper portion protective layer 20*a* and the second upper portion protective layer 20*b* thereon, forming the first lower portion thin film electrode 14*a* and the second lower portion thin film electrode 14*b* on the other surface of the piezoelectric body layer 12 at locations respectively corresponding to the first upper portion thin film electrode 16*a* and the second upper portion thin film electrode 16*b*, forming the lower portion protective layer 18 thereon, and providing the side surface insulating layer 60 which covers the piezoelectric body layer 12 at the end portions of the first upper portion protective layer 20*a* and the second upper portion protective layer 20*b* and the peripheries of the first upper portion protective layer 20*a* and the second upper portion protective layer 20*b*. Here, the first upper portion thin film electrode 16*a* and the first lower portion thin film electrode 14*a* form a first electrode pair, and the second upper portion thin film electrode 16*b* and the second lower portion thin film electrode 14*b* form a second electrode pair.

That is, the conversion film 114 has a constitution in which a predetermined region of the piezoelectric body layer 12 is sandwiched by the respective electrode pairs (the upper portion thin film electrode 16 and the lower portion thin film electrode 14) and this laminate is sandwiched by the upper portion protective layer 20 and the lower portion protective layer 18.

The region sandwiched by the first upper portion thin film electrode 16*a* and the first lower portion thin film electrode 14*a* (the first electrode pair) and the region sandwiched by the second upper portion thin film electrode 16*b* and the second lower portion thin film electrode 14*b* (the second electrode pair) as described above are respectively driven (vibrated) depending on applied voltage.

The regions sandwiched by the electrode pair as described above respectively serve as vibration regions. In addition, the region sandwiched by the first electrode pair is considered as a first vibration region 114*a*, and the region sandwiched by the second electrode pair is considered as a second vibration region 114*b*.

That is, the conversion film 114 has two vibration regions that are driven by mutually different signals.

At this time, in the present invention, since the piezoelectric body layer 12 is formed by dispersing the piezoelectric body particles 38 in the viscoelastic matrix 36 made of the macromolecular material that is viscoelastic at normal temperature, there are no cases in which vibrations in the respective vibration regions intervene with each other, and thus, even in a case in which a plurality of vibration regions is formed in one conversion film 114, the respective vibration regions are capable of favorably generating sound respectively.

Therefore, even in a case in which a constitution in which a plurality of the conversion units 112 in which the conversion film 114 having a plurality of vibration regions is used is arranged on the rear surface side of the display device 102 and sound that is generated from the substance that serves as the generation source of the sound is reproduced using a vibration region disposed at the location of the substance that serves as the generation source of the sound on a video that is displayed on the display device 102 is provided, the video and the sound source location match each other, and a sufficient realistic feeling can be obtained.

The use of the conversion units 112 in which the conversion film 114 having a plurality of vibration regions is used enables an increase in the number of vibration regions, the generation of sound from the location of the substance that serves as the generation source of the sound at a higher accuracy, and an increase in the so-called resolution of sound.

Here, in the example illustrated in FIG. 5A and FIG. 5B, the video audio system is provided with the constitution in which one conversion unit 112 has two vibration regions 114*a* and 114*b*, but the constitution is not limited thereto, and the video audio system may be provided with a constitution in which one conversion unit has three or more vibration regions. That is, the conversion film may be provided with a constitution in which the piezoelectric body layer is sandwiched by three or more electrode pairs.

In addition, in the example illustrated in the drawings, the video audio system is provided with the constitution in which the plurality of conversion units 112 in which the conversion film 114 having the plurality of vibration regions is used is arranged on the rear surface side of the display device 102, but the constitution is not limited thereto, and the video audio system may be provided with a constitution in which one conversion unit 112 in which the conversion film 114 having the plurality of vibration regions is used is disposed on the rear surface side of the display device 102.

That is, the video audio system may be provided with a constitution in which one conversion unit in which a conversion film having a plurality of vibration regions throughout on the entire rear surface side of the display device 102 and having a size corresponding to that of the entire rear surface of the display device 102 is disposed on the rear surface side of the display device 102.

A method for manufacturing the conversion film 114 having the constitution in which the piezoelectric body layer 12 is sandwiched by the plurality of electrode pairs is not particularly limited. As an example, in the above-described method for manufacturing the conversion film 10, when the sheet-like substances 11*a* and 11*c* are produced by forming the thin film electrodes (the lower portion thin film electrode 14 and the upper portion thin film electrode 16) on the surface of the protective layers (the lower portion protective layer 18 and the upper portion protective layer 20) by means of vacuum deposition or the like, the thin film electrodes may be formed by being patterned in a predetermined shape and disposition.

The video audio system of the present invention can be used as a screen and a speaker in movie theaters. In addition, the video audio system of the present invention can also be used as a display device and a speaker in home theaters, digital signage, projection mapping, flexible organic EL displays, and the like.

In addition, since the conversion units in which the conversion film having the macromolecular composite piezoelectric body formed by dispersing the piezoelectric body particles in the viscoelastic matrix formed of a macromolecular material that is viscoelastic at normal temperature sandwiched by the thin film electrodes is used are used as the conversion units, the conversion units can be imparted with flexibility and can be preferably combined with flexible display devices such as a projector screen or a flexible organic EL display.

In addition, a speaker system of the related art such as a 2.1-channel speaker system or a 5.1-channel speaker system may also be used in combination with the video audio system of the present invention.

For example, when a sound is reproduced from a substance that serves as the generation source of sound (sound source) in a scene in which the sound source is not displayed on a video that is displayed on the display device, that is, in a scene in which the sound source is present outside the video, the sound may be reproduced by setting a virtual sound source in the same manner as in a speaker system of the related art, and, on the other hand, when a sound is reproduced from the sound source in a scene in which the sound source is displayed on a video that is displayed on the display device, the sound may be reproduced using the video audio system of the present invention.

Hitherto, the video audio system of the present invention has been described in detail, but the present invention is not limited to the above-described examples, and it is needless to say that a variety of improvements or modifications may be carried out within the scope of the gist of the present invention.

EXAMPLES

Hereinafter, the present invention will be described in more detail using specific examples of the present invention.

Example 1

The conversion film 10 illustrated in FIG. 3 was produced using the above-described method illustrated in FIG. 4A to FIG. 4E.

First, cyanoethylated PVA (CR-V manufactured by Shin-Etsu Chemical Co., Ltd.) was dissolved in methyl ethyl ketone (MEK) in the following compositional ratio. After that, PZT particles were added to this solution in the following compositional ratio and dispersed using a propeller mixer (rotation speed: 2,000 rpm), thereby preparing paint for forming the piezoelectric body layer 12.

PZT particles . . . 1,000 parts by mass

Cyanoethylated PVA . . . 100 parts by mass

MEK . . . 600 parts by mass

Meanwhile, as the PZT particles, particles obtained by sintering the powder of a commercially available PZT raw material at 1,000° C. to 1,200° C. and then crushing and classifying the powder so that the average particle diameter reached 3.5 μm.

Meanwhile, each of the sheet-like substances 11*a* and 11*c* was prepared by depositing a 0.1 μm-thick copper thin film on a 4 μm-thick PET film in a vacuum. That is, in the present example, the upper portion electrode 16 and the lower portion electrode 14 were the 0.1 μm-thick copper-deposited thin films, and the upper portion protective layer 20 and the lower portion protective layer 18 were the 4 μm-thick PET films.

Meanwhile, in order to obtain favorable handleability in the process, a PET film to which a 50 μm-thick separator (temporary support PET) was attached was used as the PET film, and the separator of each of the protective layers was removed after the thermal compression of the thin film electrode and the protective layer.

The previously-prepared paint for forming the piezoelectric body layer 12 was applied onto the lower portion electrode 14 (copper-deposited thin film) of the sheet-like substance 11*a* using a slide coater. Meanwhile, the paint was applied so that the film thickness of the dried coating reached 20 μm.

Next, a substance obtained by applying the paint on the sheet-like substance 11*a* was heated and dried in an oven at 120° C., thereby evaporating MEK. Therefore, the laminate 11*b* having the copper lower portion electrode 14 on the PET lower portion protective layer 18 and having the 20 μm-thick piezoelectric body layer 12 (piezoelectric layer) formed thereon was produced.

On the piezoelectric body layer 12 in the laminate 11*b*, a polarization treatment was carried out by means of corona polling illustrated in FIG. 4C and FIG. 4D. Meanwhile, the polarization treatment was carried out by setting the temperature of the piezoelectric body layer 12 to 100° C. and applying a direct-current voltage of 6 kV between the lower portion electrode 14 and the corona electrode 30 so as to cause corona discharging.

The sheet-like substance 11*c* was laminated on the polarization-treated laminate 11*b* so that the coated surface of a film obtained by applying a mixture of cyanoethylated pullulan and cyanoethylated PVA (CR-M manufactured by Shin-Etsu Chemical Co., Ltd.) on the upper portion electrode 16 (copper thin film side) to a thickness of 0.3 μm faced the piezoelectric body layer 12.

Next, the laminate of the laminate 11*b* and the sheet-like substance 11*c* was thermally compressed at 120° C. using a lamination device, thereby adhering the piezoelectric body layer 12, the upper portion electrode 16, and the lower portion electrode 14 and thus producing the flat conversion film 10.

The produced conversion film 10 was combined into the case 42, thereby producing the conversion unit 40.

Here, the size of a vibration region in the conversion unit 40 was set to 200 mm×200 mm.

As the case 42, a 4 mm-deep and 6 mm-high rectangular box-like aluminum container having one open surface, an outer dimension of 210 mm×210 mm, and an open surface size of 200 mm×200 mm was used.

In addition, the viscoelastic support 46 was disposed in the case 42. As the viscoelastic support 46, glass wool having a height of 25 mm before being assembled and a density of 32 kg/m$^3$ was used.

In addition, as the pressing member 48, a plate-like aluminum member having an opening portion size of 200 mm×200 mm was used.

The conversion film 10 was disposed so as to cover the viscoelastic support 46 and the opening portion of the case 42, and the peripheral portion was fixed using the pressing member 48, thereby imparting an appropriate tensile force and an appropriate curvature to the conversion film 10 using the viscoelastic support 46.

Meanwhile, a screen was used as the display device 102.

The size of the display surface of the display device 102 was 623 mm×1,107 mm.

Ten conversion units 40 having a 200 mm×200 mm-sized vibration region were arranged in a matrix form of two rows and five columns on the rear surface side of the display device 102, thereby producing the video audio system 100. That is, the number of the vibration regions was ten.

The proportion of the total area of the vibration region of the plurality of conversion units 40 in the area of the display surface of the display device 102 was 60%.

Example 2

The video audio system 100 was produced in the same manner as in Example 1 except for the fact that 15 conversion units 40 were arranged in a matrix form of three rows and five columns on the rear surface side of the display device 102. That is, the number of the vibration regions was 15.

The proportion of the total area of the vibration region of the plurality of conversion units 40 in the area of the display surface of the display device 102 was 90%.

Example 3

The video audio system 110 as illustrated in FIG. 5A was produced in the same manner as in Example 2 except for the fact that the conversion film 114 having two vibration regions was used.

Specifically, as each of the sheet-like substances 11*a* and 11*c*, a 0.1 μm-thick copper thin film was patterned and formed by vacuum deposition on a 4 μm-thick PET film. Two copper thin films having a size of 90 mm×200 mm were formed. The conversion unit 114 was produced in the same manner as in Example 2 except for the fact that the sheet-like substances 11*a* and 11*c* produced as described above were used, and the video audio system 110 was produced. That is, the number of the vibration regions was 30.

The proportion of the total area of the vibration region of the plurality of conversion units 40 in the area of the display surface of the display device 102 was 88%.

Comparative Example 1

A commercially available 5.1-channel speaker system (HTP-5767 manufactured by Pioneer Corporation) was disposed in the vicinity of the display device 102, thereby producing a video audio system.

[Evaluation]

<Stereoscopic Feeling>

The video signal and sound signal of a certain movie were input to the produced video audio system 100, and sensory evaluation of whether or not sound had a stereoscopic feeling was carried out on the basis of whether or not the locations matched between videos and the sound and the localization of sound was possible.

The evaluation was carried out by 20 persons' sensory evaluation, and, in a case in which 18 or more persons evaluated that sound had a stereoscopic feeling, the video audio system was evaluated as A, in a case in which 16 or more and less than 18 persons evaluated that sound had a stereoscopic feeling, the video audio system was evaluated as B, in a case in which 14 or more and less than 16 persons evaluated that sound had a stereoscopic feeling, the video audio system was evaluated as C, and, in a case in which less than 14 persons evaluated that sound had a stereoscopic feeling, the video audio system was evaluated as D.

Meanwhile, in each of Examples 1 to 3, sound data that were input to the respective conversion units (vibration regions) were produced in advance on the basis of videos, and these sound data were input to the respective conversion units in synchronization with the reproduction of the video signals, and the evaluation was carried out.

The results are shown in Table 1.

TABLE 1

| | Number of vibration regions | Proportion of area in display surface | Evaluation |
|---|---|---|---|
| Example 1 | 10 | 60% | C |
| Example 2 | 15 | 90% | B |
| Example 3 | 30 | 88% | A |
| Comparative Example 1 | — | — | D |

From Table 1, it is found that the examples of the video audio system of the present invention were more highly evaluated in terms of the stereoscopic feeling of sound and had a more favorable realistic feeling compared with the comparative example.

In addition, from the comparison between Example 1 and Example 2, it is found that the proportion of the total area of the plurality of vibration regions in the area of the region in the display device in which videos were displayed is preferably 80% or more.

In addition, from the comparison between Example 2 and Example 3, it is found that, in a case in which the number of the vibration regions is increased using the conversion units having the plurality of vibration regions, it is possible to enhance the resolution of sound and further enhance the stereoscopic feeling of sound.

From the above-described results, the effects of the present invention are clear.

EXPLANATION OF REFERENCES

10, 114: electroacoustic conversion film
11*a*, 11 *c*: sheet-like substance
11*b*: laminate
12: piezoelectric body layer
14, 14*a*, 14*b*: lower portion thin film electrode
16, 16*a*, 16*b*: upper portion thin film electrode
18: lower portion protective layer
20, 20*a*, 20*b*: upper portion protective layer
24: viscoelastic matrix
26: piezoelectric body particle
30: corona electrode
32: direct-current power supply
40, 112: electroacoustic conversion unit
42: case
46: viscoelastic support
48: pressing member
60: side surface insulating layer
100, 110: video audio system
102: display device
114*a*, 114*b*: vibration region

What is claimed is:

1. A video audio system comprising:

an electroacoustic conversion unit which includes an electroacoustic conversion film having a macromolecular composite piezoelectric body formed by dispersing piezoelectric body particles in a viscoelastic matrix formed of a macromolecular material that is viscoelastic at normal temperature and thin film electrodes respectively laminated on both surfaces of the macromolecular composite piezoelectric body, curves and supports the electroacoustic conversion film, and uses at least a part of the electroacoustic conversion film as a vibration region; and a display device which is a screen or a video display device to which videos are projected, wherein the vibration region has a square shape, a surface of the electroacoustic conversion unit on the electroacoustic conversion film side has a square shape, at least one of the electroacoustic conversion units is disposed on a rear surface opposite to a surface of the display device on which videos are displayed, and a plurality of vibration regions is arranged on the entire rear surface of the display device, the video audio system is provided with any of a constitution in which one electroacoustic conversion unit having the plurality of vibration regions is included, a constitution in which a plurality of the electroacoustic conversion units each having one vibration region is included or a constitution in which a plurality of the electroacoustic conversion units each having the plurality of vibration regions is included, location information of the vibration regions is included in sound data that are input to the electroacoustic conversion units, and a proportion of a total area of the plurality of vibration regions in an area of a region in the display device on which videos are displayed is 80% or more.

2. The video audio system according to claim 1, wherein, on the basis of videos that are displayed on the display device, at least one vibration region is selected from the plurality of vibration regions arranged on the rear surface of the display device, and sound is generated.

3. The video audio system according to claim 2, wherein four or more vibration regions are provided.

4. The video audio system according to claim 3, wherein a plurality of electroacoustic conversion units each having one vibration region is provided, and the plurality of electroacoustic conversion units is arranged on the rear surface of the display device.

5. The video audio system according to claim 3, wherein the electroacoustic conversion film has a plurality of sets of the thin film electrodes that sandwich the macromolecular composite piezoelectric body and has the plurality of vibration regions formed therein.

6. The video audio system according to claim 1, wherein four or more vibration regions are provided.

7. The video audio system according to claim 1, wherein a plurality of electroacoustic conversion units each having one vibration region is provided, and the plurality of electroacoustic conversion units is arranged on the rear surface of the display device.

8. The video audio system according to claim 1, wherein the electroacoustic conversion film has a plurality of sets of the thin film electrodes that sandwich the macromolecular composite piezoelectric body and has the plurality of vibration regions formed therein.

9. The video audio system according to claim 1 which is used in any of movie theaters, home theaters, digital signage, projection mapping, and flexible organic EL displays.

10. The video audio system according to claim 1, further comprising:

a speaker system which has two or more channels, wherein in a scene in which the sound source is displayed on a video that is displayed on the display device, sound is reproduced using at least one of the electroacoustic conversion units, and in a scene in which the sound source is not displayed on a video that is displayed on the display device, sound is reproduced using the speaker system by setting a virtual sound source.

11. The video audio system according to claim 1, wherein the display device has flexibility.

* * * * *